US010087386B2

(12) United States Patent
Hamashima et al.

(10) Patent No.: US 10,087,386 B2
(45) Date of Patent: Oct. 2, 2018

(54) WATER-SOLUBLE LUBRICANT COMPOSITION FOR PLASTICALLY WORKING ALUMINUM MATERIAL

(71) Applicant: MORESCO CORPORATION, Hyogo (JP)

(72) Inventors: Kentaro Hamashima, Hyogo (JP); Toru Makino, Hyogo (JP)

(73) Assignee: MORESCO CORPORATION, Hyogo (JP)

( * ) Notice: Subject to any disclaimer, the term of this patent is extended or adjusted under 35 U.S.C. 154(b) by 0 days.

(21) Appl. No.: 15/500,249

(22) PCT Filed: Oct. 8, 2015

(86) PCT No.: PCT/JP2015/079243

§ 371 (c)(1),
(2) Date: Jan. 30, 2017

(87) PCT Pub. No.: WO2016/098434

PCT Pub. Date: Jun. 23, 2016

(65) Prior Publication Data

US 2017/0275549 A1 Sep. 28, 2017

(30) Foreign Application Priority Data

Dec. 18, 2014 (JP) ..... 2014-256014

(51) Int. Cl.

| | |
|---|---|
| ***C10M 107/32*** | (2006.01) |
| ***C10M 169/04*** | (2006.01) |
| ***C10M 173/02*** | (2006.01) |
| ***C10M 159/06*** | (2006.01) |
| ***C10M 129/30*** | (2006.01) |

(52) U.S. Cl.

CPC ..... *C10M 107/32* (2013.01); *C10M 169/044* (2013.01); *C10M 173/02* (2013.01); *C10M 2203/022* (2013.01); *C10M 2203/0206* (2013.01); *C10M 2205/16* (2013.01); *C10M 2209/086* (2013.01); *C10M 2209/1023* (2013.01); *C10N 2220/142* (2013.01); *C10N 2230/06* (2013.01); *C10N 2240/407* (2013.01)

(58) Field of Classification Search

CPC ..... C10M 107/32; C10M 169/044; C10M 173/02; C10M 2203/0206; C10M 2203/022; C10M 2205/16; C10M 2209/086; C10M 2209/1023; C10N 2220/142; C10N 2230/06; C10N 2240/407

See application file for complete search history.

(56) References Cited

U.S. PATENT DOCUMENTS

| | | | | |
|---|---|---|---|---|
| 3,492,232 | A * | 1/1970 | Rosenberg | C10M 173/00 508/176 |
| 4,016,087 | A * | 4/1977 | Narushima | C10M 173/02 508/467 |
| 5,133,890 | A * | 7/1992 | O'Neil | C07D 231/12 508/281 |
| 5,348,672 | A | 9/1994 | Ohkura et al. | |
| 5,597,786 | A | 1/1997 | Itoh et al. | |
| 5,837,658 | A * | 11/1998 | Stork | C10M 173/02 508/421 |
| 6,204,225 | B1 * | 3/2001 | Lightcap, Jr. | C10M 173/00 508/178 |
| 6,255,260 | B1 * | 7/2001 | Stork | C10M 173/02 508/128 |

FOREIGN PATENT DOCUMENTS

| | | |
|---|---|---|
| JP | 8-157860 | 6/1996 |
| JP | 2006-335838 | 12/2006 |
| JP | 2008-69413 | 3/2008 |
| JP | 2010-106130 | 5/2010 |
| JP | 2010-106208 | 5/2010 |
| JP | 2011-42706 | 3/2011 |
| JP | 2012-177000 | 9/2012 |
| JP | 5549957 | 7/2014 |

OTHER PUBLICATIONS

International Search Report dated Dec. 1, 2015 in International (PCT) Application No. PCT/JP2015/079243.

* cited by examiner

*Primary Examiner* — James Goloboy

(74) *Attorney, Agent, or Firm* — Wenderoth, Lind & Ponack, L.L.P.

(57) ABSTRACT

A water-soluble lubricant composition for warm and hot plastically working of an aluminum material comprising
(A) hydrophilic polyester resin,
(B) alkali metal salt of a polymaleic acid resin,
(C) alkali metal salt of carboxylic acid and
(D) water, and optionally
(E) a wax.

10 Claims, No Drawings

WATER-SOLUBLE LUBRICANT COMPOSITION FOR PLASTICALLY WORKING ALUMINUM MATERIAL

TECHNICAL FIELD

The present invention relates to a water-soluble lubricant composition for plastically working aluminum material. More specifically, in plastically working an aluminum material, namely in rotational molding such as forging, extrusion, rolling, press, wire drawing and spinning processing, the present invention relates to a non-graphite-based lubricant to be used as an alternative to a graphite-based lubricant. The present lubricant composition has purpose to improve lubricating property and releasing property in warm or hot area of plastically working an aluminum material.

BACKGROUND ART

As a lubricant for plastically working metallic material usually used a graphite which is dispersed in oil or in water. The former is a lubricant in which graphite is dispersed in a composition obtained by adding an extreme pressure additive and wax in mineral oil, but there is a risk of smoke or ignition due to oil when used in warm or hot temperature which causes great problems in safety, working environment and health. The latter is a lubricant in which an extreme pressure additive is added to water and graphite is dispersed therein, there is no risk of smoking or ignition compared to oil base lubricant, and also exhibits excellent lubrication performance. However, as long as graphite is used, the workers and working environment are contaminated black and there are problems in health.

In order to solve the problem of these working environments, attempts have been made to develop a lubricant for plastic working which does not use graphite. For example, it is known a water-soluble lubricant for hot plastic working consisting essentially of (a) resin powder such as cellulose resin, acrylic resin or the like having a specific particle size distribution, (b) alkali metal salt of isophthalic acid and adipic acid, (c) water-soluble high polymer such as carboxymethyl cellulose, and (d) the balance being water (Patent Literature 1).

However, in Patent Literature 1, there is no example in which a polyester resin is used as the resin (a), and even in the specification, a polyester resin is usable but there is no description as to whether it is hydrophilic or hydrophobic. In addition, the metal materials processed in the examples are all iron materials such as S45C and S35C.

Further, as lubricants for cold plastic working, Patent Literatures 2 to 4 and the like are known. In these cold plastic working lubricants, under severe environments such as spray coating on high temperature molds and subsequent warm and hot plastic working of aluminum materials, there is a problem that the adhesion amount to the mold decreases and the strength of the lubricating coating film is insufficient, due to insufficient heat resistance of the lubricant.

PATENT LITERATURE

Patent Literature 1: U.S. Pat. No. 5,348,672
Patent Literature 2: JP 2012-177000A
Patent Literature 3: JP 5549957B1
Patent Literature 4: JP 2006-335838A

SUMMARY OF THE INVENTION

Problem to be Solved by the Invention

An object of the present invention is to provide a water-soluble lubricant composition for plastically working of an aluminum material which exhibits lubricity equal to or higher than that of a graphite-based lubricant even under severe environments of warm and hot plastic working of aluminum materials, which can improve poor mold releasability which is caused by aluminum welding to the mold.

In developing a non-graphite type lubricant as a substitute for a graphite type lubricant, the inventors of the present invention have repeatedly studied to solve various problems possessed by the conventional non-graphite type lubricant. As a result, in consideration of liquid stability, we found a hydrophilic polyester resin having a hydrophilic functional group which can be uniformly dispersed in water and having a glass transition temperature (Tg) of −20° C. or higher is preferable as a lubrication and release components. Particularly preferable is a hydrophilic polyester resin having a rigid naphthalene structure or bisphenol structure which can improve heat resistance and film hardness.

We found also, as a further lubricating component, it is preferable to use an alkali metal salt of carboxylic acid and, as required, wax, and to use an alkali metal salt of a polymaleic acid resin as a binder component having high heat resistance. Then, we developed a water-soluble lubricant composition for plastically working of an aluminum material. It was found that lubricity of the composition is equal to or higher than that of the graphite type lubricant and that aluminum welding to the mold can be improved. Further, it has been found that extremely excellent lubricity can be exhibited as compared with the conventional non-graphite type lubricant, and aluminum welding to a mold can be improved, and we have accomplished the present invention.

Means for Solving the Problem of the Invention

The present invention provides the following.

1. A water-soluble lubricant composition for warm and hot plastically working of an aluminum material comprising
(A) hydrophilic polyester resin,
(B) alkali metal salt of a polymaleic acid resin,
(C) alkali metal salt of carboxylic acid and
(D) water.

2. A composition according to 1, further comprising (E) a wax.

3. A composition according to any one of 1 and 2, wherein the hydrophilic polyester resin is a hydrophilic polyester resin having a naphthalene structure or a bisphenol structure.

4. A composition according to any one of 1 to 3, wherein the hydrophilic polyester resin is a polyester resin having at least one of an alkali metal salt, an ammonium salt or an amine salt of a carboxyl group, an alkali metal salt, an ammonium salt or an amine salt of a sulfonyl group as a hydrophilic functional group.

5. A composition according to 1, wherein the hydrophilic polyester resin has a glass transition temperature (Tg) of −20 to 200° C.

6. A composition according to 5, wherein the hydrophilic polyester resin has a glass transition temperature (Tg) of 40 to 110° C.

7. A composition according to 1, which comprises 0.01 to 10% by weight of (A), 0.01 to 10% by weight of (B), 0.01 to 20% by weight of (C), the balance being (D).

8. A composition according to 1, which comprises 0.01 to 10% by weight of (A), 0.01 to 10% by weight of (B), 0.01 to 20% by weight of (C), 0.01 to 10% by weight of (E), the balance being (D).

9. A lubricant composition for spinning of an aluminum wheel according to any one of the above 1 to 8.

Effect of the Invention

The water-soluble lubricant composition for plastically working of an aluminum material of the present invention exhibits lubricity equal to or higher than that of a graphite-based lubricant even under severe environments of warm and hot plastic working of aluminum materials, which can improve poor mold releasability which is caused by aluminum welding to the mold. Accordingly, the present invention is extremely large in industrial application value.

EMBODIMENT OF PRACTICING THE INVENTION

Each component of the water-soluble plastic working lubricant of the present invention will be described in detail below.

(A) Hydrophilic Polyester Resin

The polyester resin (A) used in the lubricant composition for water-soluble plastic working of the aluminum material of the present invention is preferably a polyester resin having hydrophilic functional group introduced into the polyester main chain which can be uniformly dispersed in water in consideration of liquid stability for suppressing sedimentation and deposition of the resin. Examples of the hydrophilic functional group include an alkali metal salt, an ammonium salt, an amine salt of a carboxyl group, an alkali metal salt, an ammonium salt, an amine salt of a sulfonyl group. These functional groups may be used singly or in combination of at least two of them.

In addition, the hydrophilic polyester resin (A) of the present invention is contained in order to achieve both lubricity and mold releasability in severe environments of warm and hot plastic working of aluminum materials.

For this purpose, it is important that the hydrophilic polyester resin is uniformly dispersed in water with a hydrophilic group in the composition and form hard rigid (strong) coating by thermally decomposed without reducing amount of adhesion when dried on a high-temperature mold. As the hydrophilic polyester resin having such properties, the glass transition temperature (Tg) is −20° C. or higher, preferably 0° C. or higher, more preferably 20° C. or higher, particularly preferably 40° C. or higher. Tg is 200° C. or less, preferably 180° C. or less, more preferably 150° C. or less, particularly preferably 110° C. or less. It is preferably −20 to 200° C., more preferably 20 to 180° C., 40 to 150° C. and 40 to 110° C.

Among them, more preferable is a hydrophilic polyester resin having a rigid naphthalene structure or a bisphenol structure. Those having such a structure are excellent in heat resistance and can form a strong and hard lubricating film, so that it is possible to suppress the metal contact between the mold and the aluminum material in the warm and hot regions, and achieve both lubricity and releasability. In particular, a composition containing a hydrophilic polyester resin having a bisphenol structure is particularly preferable because high lubricity of friction coefficient of less than 0.14 can be stably obtained at a low concentration.

The hydrophilic polyester resin (A) is not particularly limited, but it is usually preferable that the hydrophilic polyester resin has a weight average molecular weight of 1000 to 1,000,000, preferably 1000 to 100,000.

(B) Alkali Metal Salt of a Polymaleic Acid Resin

The alkali metal salt (B) of the polymaleic acid resin used in the present invention is thickened after dissolving in water and is useful for dispersing the hydrophilic polyester resin. In addition, when the salt is spray-coated on a hot mold, it improves the adhesion efficiency of the hydrophilic polyester resin, the alkali metal salt of the carboxylic acid and the wax which are the lubricating components. Accordingly, the salt functions as a binder component for forming a homogeneous, strong and hard film having heat resistance even under severe environments of warm and hot plastic working.

Examples of polymaleic acid resin include, for example, isobutylene/maleic anhydride copolymer, styrene/maleic anhydride copolymer, methyl vinyl ether/maleic anhydride copolymer and α-methylstyrene/maleic anhydride copolymer. Examples of the alkali metal include sodium and potassium. Specifically, it forms a salt with sodium hydroxide or potassium hydroxide and is made water soluble. Furthermore, the alkali metal salts (B) of these polymaleic acid resins may be used singly or in combination of at least two of them.

Carboxymethyl cellulose and hydroxyethyl cellulose are frequently used as a usual binder component, but the residual ratio of hydroxy cellulose is about 50% under the environment of 300° C., the residual ratio of sodium salt of isobutylene maleic anhydride is about 94%. The former is markedly weaker in heat resistance than the latter alkali metal salt of polymaleic acid resin and is distinguished from the latter.

(C) Alkali Metal Salt of Carboxylic Acid

The alkali metal salt (C) of the carboxylic acid used in the present invention is for further improving the lubricity, especially the followability of the lubricating coating film under severe environments of warm and hot plastic working of the aluminum material. After spray coating, it is considered that a lubricating coating film is present on the surface of the metal mold as an aggregate in which a hydrophilic polyester resin and crystals of an alkali metal salt of a carboxylic acid are superimposed in an alkali metal salt of a polymaleic acid resin which is a binder component. This forms a heat resistant, homogeneous, strong and hard coating. When a surface pressure enough to cause plastic deformation is applied by pressing an aluminum material against the lubricating film formed on the surface of the metal mold, lateral misalignment of individual tissues at the interface improves followability. It is thought that the lubricating film breakage is suppressed. This is a phenomenon similar to the cleavage of the graphite crystal, and excellent lubricity and releasability are obtained.

Examples of the carboxylic acid are saturated carboxylic acids such as oxalic acid, malonic acid, succinic acid, malic acid, citric acid, adipic acid, azelaic acid, sebacic acid, dodecanedioic acid, 1,2-cyclohexanedicarboxylic acid and hexahydrophthalic anhydride, unsaturated carboxylic acids such as fumaric acid, maleic acid, itaconic acid, 1,2,3,6-tetrahydrophthalic anhydride, 4-cyclohexene-1,2-dicarboxylic acid, 1-cyclohexene-1,2-dicarboxylic acid and cyclohexene-1,2-dicarboxylic anhydride, aromatic carboxylic acids such as benzoic acid, salicylic acid, phthalic anhydride, phthalic acid, isophthalic acid, terephthalic acid, trimellitic acid and naphthalene dicarboxylic acid. Examples of the alkali metal include sodium and potassium. Specifically, it foams a salt with sodium hydroxide or potassium hydroxide and is made water soluble. Furthermore, the component (C) may be used singly or in combination of at least two of them.

(D) Water.

As water (D), purified water such as ion exchange water or pure water is preferable.

(E) Wax

The wax (E) used in the lubricant composition of the present invention for water-soluble plastic working of the aluminum material is melted by the processing temperature at the time of plastic working exceeding its melting point, and the friction between the metal mold and the aluminum material is decreased. As a lubricating film after spray application, it is considered that a hydrophilic polyester resin, a crystal of an alkali metal salt of a carboxylic acid and a wax are present in an alkali metal salt of a polymaleic acid resin which is a binder component as an aggregate on the metal surface. Further, it is considered that tissues improve lateral misalignment at the interface, thereby improving followability and suppressing lubricant film breakage. Therefore, it is preferable to use one or more waxes selected from the group consisting of natural wax and synthetic wax having a melting point of about 0 to 200° C., preferably about 40 to 160° C.

Examples of the wax (E) include, for example, hydrogenated cured waxes such as beef tallow and pork fat as natural wax, lanolin, beeswax, spermaceti, paraffin wax, carnauba wax, montan wax, microcrystalline wax, rice bran wax, candelilla wax and the like, and synthetic waxes such as polyethylene wax and polypropylene wax. The wax (E) is not an essential component of the present composition, but from the viewpoint of friction reduction mentioned above, it is preferably contained in the lubricant composition for water-soluble plastic working of the present invention by combining one or more kinds of the wax dispersed in water in the state of dispersion or emulsion.

The process for preparing the lubricant composition for water-soluble plastic working of the aluminum material of the present invention is not particularly limited and it is preferable to mix four components (A) to (D), or five components (A) to (E), for example, in the following procedure. Preferably, for example, an alkali metal salt is added to water to form a solution, and then a polymaleic acid resin (B) is added thereto while heating and stirring at 40 to 100° C. to dissolve the resin by neutralization reaction. After the polymaleic acid resin is dissolved, an alkali metal salt is further added to the solution to prepare a solution, and carboxylic acid is added while heating and stirring at 40 to 100° C. to prepare a solution by the neutralization reaction. After cooling the aqueous solution to room temperature, hydrophilic polyester resin (A) is added thereto and stirred to form a solution. Wax (E) can then also optionally be added. Examples of the alkali metal salt are sodium hydroxide and potassium hydroxide.

When using the four components (A) to (D) in the present invention, it is preferable to use 0.01 to 10% by weight of (A), 0.01 to 10% by weight of (B), 0.01 to 20% by weight of (C), and (D) as the remainder. It is more preferable to use 0.01 to 5% by weight of (A), 0.01 to 5% by weight of (B), 0.01 to 15% by weight of (C) and (D) as the remainder. It is particularly preferable to use 0.1 to 2% by weight of (A), 0.1 to 2% by weight of (B), 0.1 to 10% by weight of (C) and the remainder of (D).

Further, when using the component (E), it is preferable to use 0.01 to 10% by weight of (A), 0.01 to 10% by weight of (B), 0.01 to 20% by weight of (C), 0.01 to 10% by weight of (E), and (D) as the remainder. It is more preferable to use 0.01 to 5% by weight of (A), 0.01 to 5% by weight of (B), 0.01 to 15% by weight of (C), 0.01 to 5% by weight of (E), and (D) as the remainder. It is particularly preferable to use 0.1 to 2% by weight of (A), 0.1 to 2% by weight of (B), 0.1 to 10% by weight of (C), 0.1 to 2% by weight of (E), and the remainder of (D).

The aluminum material of the present invention is used, for example, for automobile parts/motorcycle parts, electric parts, aircraft parts.

In the present invention, the warm region of the aluminum material for warm and hot plastic working indicates 200 to 350° C., and the hot region means 350 to 450° C.

In the present invention, for example, when spinning an aluminum wheel for an automobile, the lubricant of the present invention is sprayed onto a heated mandrel (metal mold), then a heated aluminum wheel is placed on the mandrel, and aluminum spray coating is also applied to the rim portion of the wheel, and thereafter spinning is applied to the rim portion of the aluminum wheel to obtain desired formability (dimensional accuracy) and releasability.

EXAMPLES

The invention will be described in more detail with reference to the following examples and comparative examples to which, however, the invention is not limited.

Examples 1 to 11 and Comparative Examples 1 to 6

Sodium hydroxide was added to water to form a solution, and then polymaleic acid resin was added thereto while heating and stirring at 80° C. to obtain a solution by neutralization reaction. After dissolving the polymaleic acid resin, NaOH was further added to the solution to form a solution, and carboxylic acid was added while heating and stirring at 80° C. to obtain a solution by neutralization reaction. After cooling the aqueous solution to room temperature, a hydrophilic polyester resin was added and stirred to prepare a solution. Next, wax was optionally added and mixed. In this manner, lubricant compositions for water-soluble plastic working of aluminum materials of Examples and Comparative Examples having the blending amounts described in the Table were prepared.

In Tables 1 to 5, the numerical values of the amounts in each Table indicate the weight % of the solid content. As Comparative Example 1, a composition containing a graphite-based lubricant was prepared and used for comparison. As Comparative Example 2, a composition containing the polyester resin used in Patent Literature 2 was prepared and used for comparison.

As Comparative Example 3, a composition containing the polyester resin used in Patent Literature 2, an alkali metal salt of an inorganic acid and wax, which also containing the components in the same amounts as in Patent Literature 2 was prepared and used for comparison.

As Comparative Example 4, a composition not containing the alkali metal salt of polymaleic acid resin of Example 9 was prepared and used for comparison. As Comparative Example 5, a composition not containing the alkali metal salt of carboxylic acid of Example 9 was prepared and used for comparison. In Comparative Example 6, a composition in which the alkali metal salt of polymaleic acid resin of Example 9 was substituted with hydroxyethyl cellulose was prepared and used for comparison.

In the Table, the following hydrophilic polyester resin (A) was used.

(A-1) Polyethylene terephthalate (PET) type polyester aqueous dispersion

Molecular weight: 3000

Hydrophilic group: —$COONH_4$

Tg: 52° C.

(A-2) PET type polyester aqueous dispersion
Molecular weight: 20000
Hydrophilic group: —$SO_3Na$
Tg: 77° C.
(A-3) PET type polyester aqueous dispersion
Molecular weight: 15000
Hydrophilic group: —$SO_3Na$
Tg: 20° C.
(A-4) PET type polyester aqueous dispersion
Molecular weight: 15000
Hydrophilic group: —$SO_3Na$
Tg: −20° C.
(A-5) Polyethylene naphthalate (PEN) type polyester aqueous dispersion
Molecular weight: 26000
Hydrophilic group: —$SO_3Na$
Tg: 40° C.
(A-6) PEN type polyester aqueous dispersion
Molecular weight: 26000
Hydrophilic group: —$SO_3Na$
Tg: 110° C.
(A-7) PEN type polyester aqueous dispersion
Molecular weight: 28000
Hydrophilic group: —$SO_3Na$ (less than that of (A-6)
Tg: 110° C.
(A-8) Bisphenol A type polyester aqueous dispersion (Carboxylic acid/bisphenol A series)
Molecular weight: 4000
Hydrophilic group: —COOH/amine
Tg: 60° C.
(A-9) Bisphenol A type polyester aqueous dispersion
Molecular weight: 5000
The carboxylic acid moiety is different from (A-8).
Hydrophilic group: —COOH/amine
Tg: 72° C.
(A-10) Bisphenol A type polyester aqueous dispersion
Molecular weight: 4500
The carboxylic acid moiety is different from (A-8) and (A-9).
Hydrophilic group: —COOH/amine
Tg: 65° C.
(A-11) Polyester polyol
Molecular weight: unknown
Hydrophilic group: None
Tg: −36° C.

In the Table, the following sodium salt of polymaleic acid resin (B) was used.
(B-1) Sodium salt of isobutylene maleic anhydride In the Table, the following alkali metal salt of carboxylic acid (C) was used.
(C-1) disodium adipate
(C-2) disodium isophthalate
In the Table, the following wax (E) was used.
(E-1) Paraffin wax
In the Table, the following cellulose type polymer (F) was used.
(F-1) hydroxyethyl cellulose
In the Table, the following alkali metal salt of inorganic acid (G) was used.
(G-1) sodium pyrophosphate
In the Table, the following commercially available graphite-based lubricant (H) was used.
(H-1) graphite-based lubricant Spray Coating Hardness The lubricant composition for water-soluble plastic working of aluminum materials of Examples and Comparative Examples was spray-coated on an iron mold heated to 300° C. under the conditions of spray pressure of 0.3 MPa, spray distance of 300 mm, 4 cc/10 sec. After spray application, the mold temperature was returned to room temperature, and the film hardness was judged by the degree of peeling of the coating film when the film adhered to the mold was rubbed with cloth. When rubbed ten times, it is "x soft" for those in which the base of the mold can easily be watched, and "○ hard" for the case where the coating does not easily peel off even if rubbed 10 times.

Lubricity Test

Friction coefficient was measured by ring compression test. The lubricant composition for water-soluble plastic working of aluminum materials of Examples and Comparative Examples was spray-coated on an iron mold under the above spraying conditions. The mold was set in a 100 t press. Next, an aluminum ring (material: A5052, shape: φ54×φ27×18 mm) was heated to 350° C. in an electric furnace and pressed between upper and lower molds. The friction coefficient was calculated by compression rate and inner diameter deformation.

Presence or Absence of Aluminum Weld to Mold

After the ring compression test, the degree of aluminum adhesion on the mold surface was evaluated by appearance. "X presence" indicates that aluminum welding is observed, and "O absence" indicates that aluminum welding is not observed.

TABLE 1

| composition | | Ex. 1 | Ex. 2 | Ex. 3 | Ex. 4 |
|---|---|---|---|---|---|
| hydrophilic polyester resin (A) | A-1 | 0.8 | — | — | — |
| | A-2 | — | 0.65 | — | — |
| | A-3 | — | — | 0.25 | — |
| | A-4 | — | — | — | 0.25 |
| | A-5 | — | — | — | — |
| | A-6 | — | — | — | — |
| | A-7 | — | — | — | — |
| | A-8 | — | — | — | — |
| | A-9 | — | — | — | — |
| | A-10 | — | — | — | — |
| | A-11 | — | — | — | — |
| alkali metal salt of polymaleic acid resin (B) | B-1 | 1.6 | 1.6 | 1.6 | 1.6 |
| alkali metal salt of carboxylic acid (C) | C-1 | 7.2 | 7.2 | 7.2 | 7.2 |
| | C-2 | — | — | — | — |
| wax (E) | E-1 | — | 0.8 | 0.5 | 0.5 |
| cellulose type polymer (F) | F-1 | — | — | — | — |
| alkali metal salt of inorganic acid (G) | G-1 | — | — | — | — |
| commercially available graphite-based lubricant (H) | H-1 | — | — | — | — |
| water (D) | | balance | balance | balance | balance |
| spray coating hardness | | ○ hard | ○ hard | ○ hard | ○ hard |
| ring compression test | friction coefficient | 0.128 | 0.112 | 0.145 | 0.143 |
| | presence or absence of aluminum weld to mold | ○ absence | ○ absence | ○ absence | ○ absence |

TABLE 2

| composition | | Ex. 5 | Ex. 6 | Ex. 7 | Ex. 8 |
|---|---|---|---|---|---|
| hydrophilic polyester resin (A) | A-1 | — | — | — | — |
| | A-2 | — | — | — | — |
| | A-3 | — | — | — | — |
| | A-4 | — | — | — | — |
| | A-5 | 0.25 | — | — | — |
| | A-6 | — | 0.4 | 0.8 | — |
| | A-7 | — | — | — | 0.4 |
| | A-8 | — | — | — | — |
| | A-9 | — | — | — | — |
| | A-10 | — | — | — | — |
| | A-11 | — | — | — | — |

TABLE 2-continued

| composition | | Ex. 5 | Ex. 6 | Ex. 7 | Ex. 8 |
|---|---|---|---|---|---|
| alkali metal salt of polymaleic acid resin (B) | B-1 | 1.6 | 1.6 | 1.6 | 1.6 |
| alkali metal salt of carboxylic acid (C) | C-1 | 7.2 | 7.2 | — | 7.2 |
| | C-2 | — | — | 7.2 | — |
| wax (E) | E-1 | — | — | — | — |
| cellulose type polymer (F) | F-1 | — | — | — | — |
| alkali metal salt of inorganic acid (G) | G-1 | — | — | — | — |
| commercially available graphite-based lubricant (H) | H-1 | — | — | — | — |
| water (D) | | balance | balance | balance | balance |
| spray coating hardness | | ○ hard | ○ hard | ○ hard | ○ hard |
| ring compression test | friction coefficient | 0.119 | 0.133 | 0.110 | 0.132 |
| | presence or absence of aluminum weld to mold | ○ absence | ○ absence | ○ absence | ○ absence |

TABLE 3

| composition | | Ex. 9 | Ex. 10 | Ex. 11 | Com. Ex. 1 |
|---|---|---|---|---|---|
| hydrophilic polyester resin (A) | A-1 | — | — | — | — |
| | A-2 | — | — | — | — |
| | A-3 | — | — | — | — |

TABLE 3-continued

| composition | | Ex. 9 | Ex. 10 | Ex. 11 | Com. Ex. 1 |
|---|---|---|---|---|---|
| | A-4 | — | — | — | — |
| | A-5 | — | — | — | — |
| | A-6 | — | — | — | — |
| | A-7 | — | — | — | — |
| | A-8 | 0.25 | — | — | — |
| | A-9 | — | 0.25 | — | — |
| | A-10 | — | — | 0.25 | — |
| | A-11 | — | — | — | — |
| alkali metal salt of polymaleic acid resin (B) | B-1 | 1.6 | 1.6 | 1.6 | 1.6 |
| alkali metal salt of carboxylic acid (C) | C-1 | 7.2 | 7.2 | 7.2 | 7.2 |
| | C-2 | — | — | — | — |
| wax (E) | E-1 | 0.5 | 0.5 | 0.5 | — |
| cellulose type polymer (F) | F-1 | — | — | — | — |
| alkali metal salt of inorganic acid (G) | G-1 | — | — | — | — |
| commercially available graphite-based lubricant (H) | H-1 | — | — | — | 1.3 |
| water (D) | | balance | balance | balance | balance |
| spray coating hardness | | ○ hard | ○ hard | ○ hard | ○ hard |
| ring compression test | friction coefficient | 0.131 | 0.135 | 0.131 | 0.145 |
| | presence or absence of aluminum weld to mold | ○ absence | ○ absence | ○ absence | ○ absence |

TABLE 4

| composition | | Comparative Example 2 | 3 | 4 | 5 | 6 |
|---|---|---|---|---|---|---|
| hydrophilic polyester resin (A) | A-1 | — | — | — | — | — |
| | A-2 | — | — | — | — | — |
| | A-3 | — | — | — | — | — |
| | A-4 | — | — | — | — | — |
| | A-5 | — | — | — | — | — |
| | A-6 | — | — | — | — | — |
| | A-7 | — | — | — | — | — |
| | A-8 | — | — | 0.25 | 0.25 | 0.25 |
| | A-9 | — | — | — | — | — |
| | A-10 | — | — | — | — | — |
| | A-11 | 0.4 | 5.0 | — | — | — |
| alkali metal salt of polymaleic acid resin (B) | B-1 | 1.6 | — | — | 1.6 | — |
| alkali metal salt of carboxylic acid (C) | C-1 | 7.2 | — | 7.2 | — | 7.2 |
| | C-2 | — | — | — | — | — |
| wax (E) | E-1 | — | 1.0 | 0.5 | 0.5 | 0.5 |
| cellulose type polymer (F) | F-1 | — | — | — | — | 1.6 |
| alkali metal salt of inorganic acid (G) | G-1 | — | 5.0 | — | — | — |
| commercially available graphite-based lubricant (H) | H-1 | — | — | — | — | — |
| water (D) | | balance | balance | balance | balance | balance |
| spray coating hardness | | x soft | x soft | x soft | x soft | x soft |
| ring compression test | friction coefficient | 0.191 | 0.3< | 0.198 | 0.3< | 0.139 |
| | presence or absence of aluminum weld to mold | X presence | X presence | X presence | X presence | X presence |

Comparative Examples 2 and 3 in which a hydrophilic polyester resin used in Patent Literature 2 and having low glass transition temperature (Tg) of −36° C. was blended, were inferior in all of spray coating hardness, coefficient of friction, aluminum deposition to the metal mold to that of the graphite-based lubricant of Comparative Example 1.

The hydrophilic polyester resin blend system of Examples 1 to 11 exhibited lubricity equal to or higher than that of the graphite-based lubricant of Comparative Example 1. Above all, Examples 5 to 11 in which the hydrophilic polyester resin having the naphthalene structure or the bisphenol structure was blended show higher lubricity of friction coefficient of less than 0.14 at a lower concentration than that of Examples 1 to 4 in which the terephthalic acid type hydrophilic polyester resin was used. In particular, Examples 9 to 11 are particularly preferable in which the hydrophilic polyester resin having the bisphenol structure was blended because higher lubricity of friction coefficient of less than 0.14 was stably obtained at a lower concentration.

After the ring compression test of Examples 1 to 11, excellent releasability was observed without sticking of the aluminum ring to the mold and aluminum welding. This is considered that the spray coating film was hard and excellent in heat resistance, and the metal contact was suppressed because the film followed between the metal mold and the aluminum material.

Comparative Example 4 in which alkali metal salt of polymaleic acid resin was not contained, Comparative Example 5 in which alkali metal salt of the carboxylic acid was not contained, Comparative Example 6 in which alkali metal salt of polymaleic acid resin was substituted with cellulose type polymer, all of them were inferior to those of the graphite-based lubricant of Comparative Example 1 in all of spray coating hardness, friction coefficient and aluminum welding to metal mold. From this, it was found that (A) hydrophilic polyester resin, (B) alkali metal salt of polymaleic acid resin, (C) alkali metal salt of carboxylic acid, and (D) water are essential components.

The lubricants for water-soluble plastic working of aluminum materials of Example 2 and Example 9 were evaluated on an actual machine using a spinning machine. A pre-determined amount of lubricant was spray coated to a heated mandrel (mold). Subsequently, a heated aluminum wheel for automobiles was installed to the mandrel and the lubricant was spray coated also on the rim portion of the aluminum wheel. Thereafter, spinning was applied to the rim portion of the aluminum wheel. After machining 3,200 aluminum wheels of 14 to 20 inches, excellent results were obtained both in moldability (dimensional accuracy) and releasability.

INDUSTRIAL APPLICABILITY

The water-soluble lubricant composition for plastically working of an aluminum material of the present invention exhibits lubricity and releasability equal to or higher than that of a graphite-based lubricant even under severe environments of warm and hot plastic working. Accordingly, the present lubricant can be suitably used as a lubricant for water-soluble plastic working of aluminum material.

The invention claimed is:

1. A water-soluble lubricant composition for warm and hot plastically working of an aluminum material comprising:
- (A) a hydrophilic polyester resin having a naphthalene structure or a bisphenol structure,
- (B) an alkali metal salt of a polymaleic acid resin,
- (C) an alkali metal salt of carboxylic acid, and
- (D) water.

2. The composition as defined in claim 1, further comprising (E) a wax.

3. The composition as defined in claim 1, wherein the hydrophilic polyester resin has a bisphenol structure.

4. The composition as defined in claim 1, wherein the hydrophilic polyester resin has at least one selected from the group consisting of an alkali metal salt of a carboxyl group, an ammonium salt of a carboxyl group, an amine salt of a carboxyl group, an alkali metal salt of a sulfonyl group, an ammonium salt of a sulfonyl group, and an amine salt of a sulfonyl group as a hydrophilic functional group.

5. The composition as defined in claim 1, wherein the hydrophilic polyester resin has a glass transition temperature (Tg) of −20 to 200° C.

6. The composition as defined in claim 5, wherein the hydrophilic polyester resin has a glass transition temperature (Tg) of 40 to 110° C.

7. The composition as defined in claim 3, wherein the hydrophilic polyester resin has a glass transition temperature (Tg) of 40 to 110° C.

8. The composition as defined in claim 1, which comprises 0.01 to 10% by weight of (A), 0.01 to 10% by weight of (B), 0.01 to 20% by weight of (C), the balance being (D).

9. The composition as defined in claim 2, which comprises 0.01 to 10% by weight of (A), 0.01 to 10% by weight of (B), 0.01 to 20% by weight of (C), 0.01 to 10% by weight of (E), the balance being (D).

10. A lubricant composition for spinning of an aluminum wheel comprising the composition as defined in claim 1.

* * * * *